US005246384A

United States Patent [19]

Sato

[11] Patent Number: 5,246,384

[45] Date of Patent: Sep. 21, 1993

[54] SHIELDED CABLE BOARD-IN CONNECTOR

[75] Inventor: Kensaku Sato, Tokyo, Japan

[73] Assignee: Hirose Electric Co., Ltd., Tokyo, Japan

[21] Appl. No.: 912,134

[22] Filed: Jul. 9, 1992

Related U.S. Application Data

[63] Continuation of Ser. No. 620,095, Nov. 30, 1990, abandoned.

[30] Foreign Application Priority Data

Mar. 15, 1990 [JP] Japan ..... 2-26529[U]

[51] Int. Cl.[5] ..... H01R 9/07

[52] U.S. Cl. ..... 439/585; 439/877; 439/581

[58] Field of Search ..... 439/578-585, 439/675, 877-881

[56] References Cited

U.S. PATENT DOCUMENTS

| | | | |
|---|---|---|---|
| 3,539,976 | 11/1970 | Reynolds | 439/585 |
| 3,594,708 | 7/1971 | Lalonde | 439/581 |
| 3,670,223 | 6/1972 | Garver | 439/585 |
| 3,728,787 | 4/1973 | McDonough | 439/585 |
| 4,010,538 | 3/1977 | O'Keefe et al. | 439/585 |
| 4,269,469 | 5/1981 | Audic | 430/585 |
| 4,781,619 | 11/1988 | Ikeda | 439/488 |

*Primary Examiner*—David L. Pirlot
*Attorney, Agent, or Firm*—Kanesaka & Takeuchi

[57] ABSTRACT

A shielded cable board-in connector (1) includes a shielding case (3) having a barrel retention portion (6), a shield wires crimping portion (7), an outer sheath crimping portion (8), and a shield terminal (19); a signal line barrel (5) having a signal terminal (14) and a signal line connection portion (15); and an insulation body (4) provided within the barrel retention portion so that the shield and signal terminals extending forwardly from a front end thereof.

6 Claims, 5 Drawing Sheets

SHIELDED CABLE BOARD-IN CONNECTOR

This application is a continuation of Ser. No. 07/620,095, filed Nov. 30, 1990, now abandoned.

BACKGROUND OF THE INVENTION

1. Field of the Invention

The present invention relates to shielded cable board-in connectors for electronic equipment of automobiles, for example.

2. Description of the Prior Art

FIG. 15 shows a conventional connector of this type, which is made by stripping a length of outer sheath of a shielded cable a and separating the shield wires b from the signal line c, bundling and connecting the shield wires b to the connection terminal d of a connector body d while connecting the signal line c to the connection terminal f by insulation displacement, for example, inserting the connection terminals e and f into the through holes of a printed circuit board g, and soldering them for mounting the connector.

FIG. 16 shows another conventional connection method which includes stripping a length of outer sheath of a shielded cable a, separating the shield wires b from the signal line c, bundling and connecting the shield wires b directly to the connection terminal e while connecting the signal line c directly to the connection terminal f by crimping, inserting the connection terminals e and f into the through holes of a printed circuit board g, and soldering them for mounting the terminals.

However, in the above conventional methods, it has been necessary to separately connect the shield wires b and the signal line c to the connection terminals e and f, respectively, making continuous and automatic connection difficult. The signal line c has been stripped of the shield wires adjacent the terminal and has had little or no shielding protection in this area.

SUMMARY OF THE INVENTION

Accordingly, it is an object of the invention to provide a shielded cable board-in connector which permits simultaneous connection of the signal line, shield wires, and outer sheath of a shielded cable, making possible continuous and automatic connection of a great number of signal lines and has an excellent shielding effect.

According to the invention there is provided a shielded cable board-in connector which includes a shielding case having a barrel retention portion, a shield wires crimping portion, an outer sheath crimping portion, and a shield terminal; a signal line barrel having a signal terminal and a signal line connection portion; and an insulation body provided within the barrel retention portion so that the shield and signal terminals extending forwardly from a front end thereof.

According to the invention, the stripped front portion of a shielded cable is placed on the board-in connector so that the signal line, the shield wires, and the outer sheath are placed on the signal line connection portion, the shield wires crimping portion, and the outer sheath crimping portion. Then, a connection jig is inserted into the jig inlet to press the signal line and crimping tabs to the signal line connection portion and the shield wires and the outer sheath for effecting simultaneous connection of the shielded cable to the board-in connector.

The above and other objects, features, and advantages of the invention will be more apparent from the following description when taken in conjunction with the accompanying drawings.

DESCRIPTION OF THE PREFERRED EMBODIMENT

Figure 1:
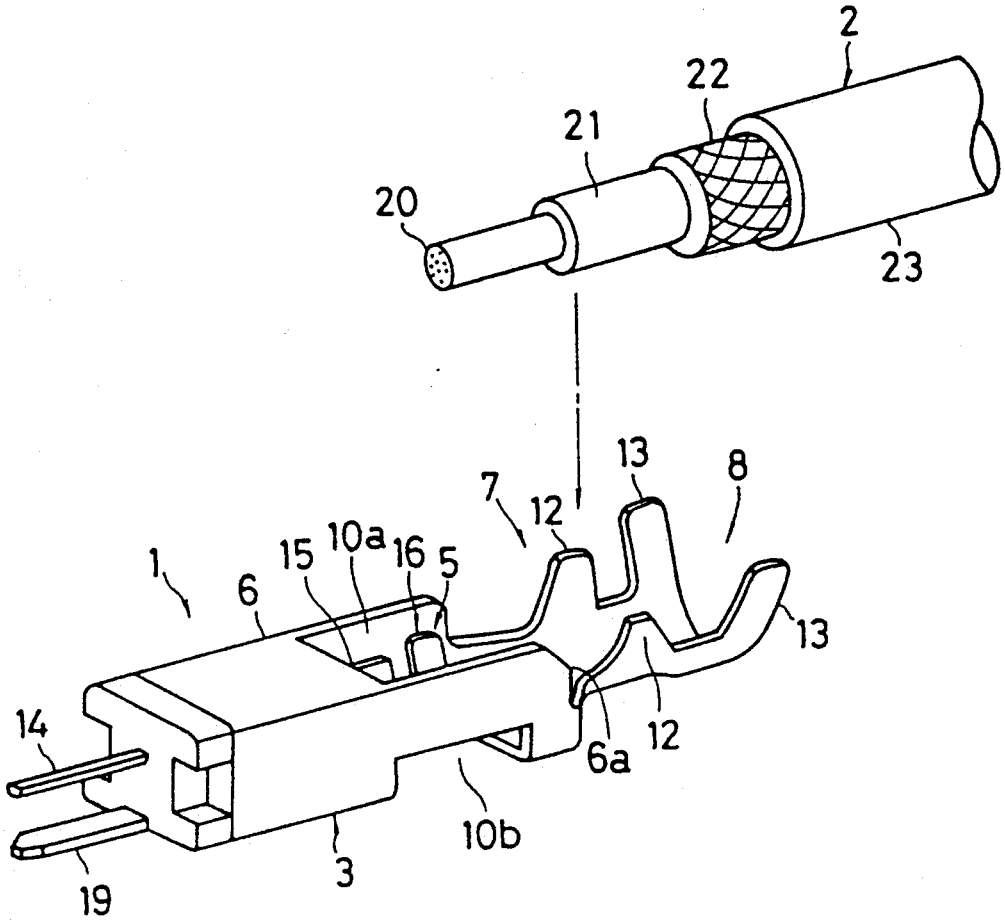
FIG. 1 is a perspective view of a shielded cable board-in connector according to an embodiment of the invention.

FIGS. 1–7 show a shielded cable board-in connector according to an embodiment of the invention. The connector 1 includes a shielding case 3; an insulation body and a signal barrel 5. The shielding case 3 is divided into three portions; a tubular barrel retention portion 6, a shield wires (outer conductor) crimping portion 7, and an outer sheath crimping portion 8. A pair of jig inlets 10*a* and 10*b* are formed behind the barrel retention portion 6, with the jig inlet 10*a* extending rearwardly from the rear edge of a top face of the barrel retention portion 6. The shield wire crimping portion 7 has a pair of U-shaped crimping tabs 1 while the outer sheath crimping portion 8 has a pair of U-shaped crimping tabs 13 which are larger than the crimping tabs 12. A shield terminal 19 extends forwardly from the front end of the shielding case 3.

Figure 2:
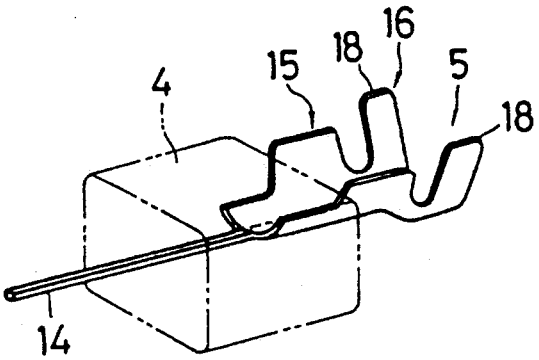
FIG. 2 is a perspective view of a signal line barrel of FIG. 1.
Figure 3:
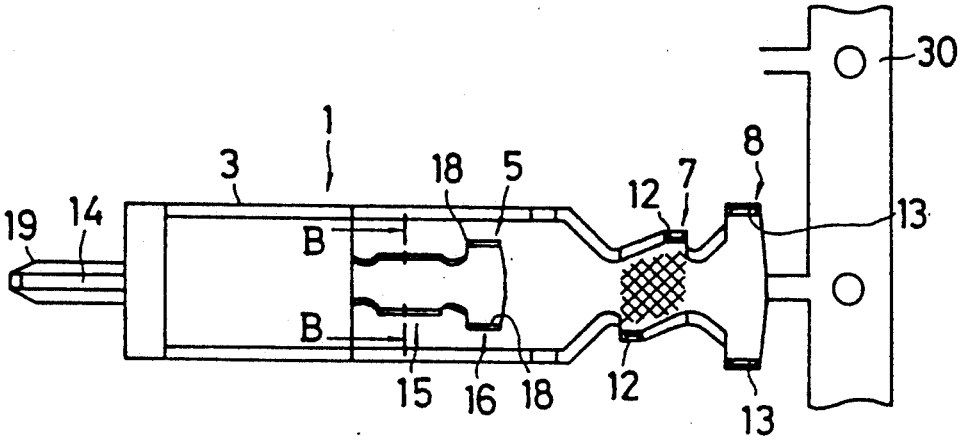
FIG. 3 is a top plan view of the board-in connector.
Figure 4:
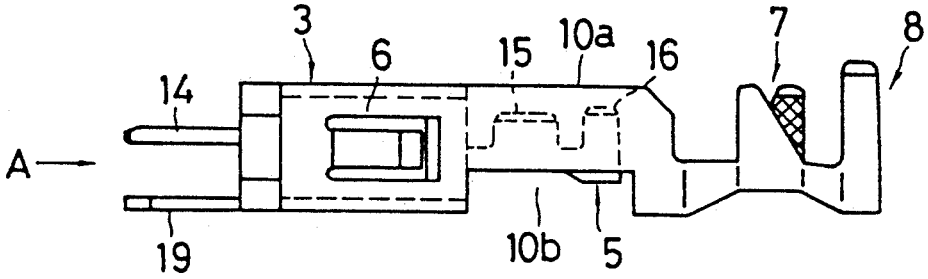
FIG. 4 is a side elevation thereof.
Figure 5:
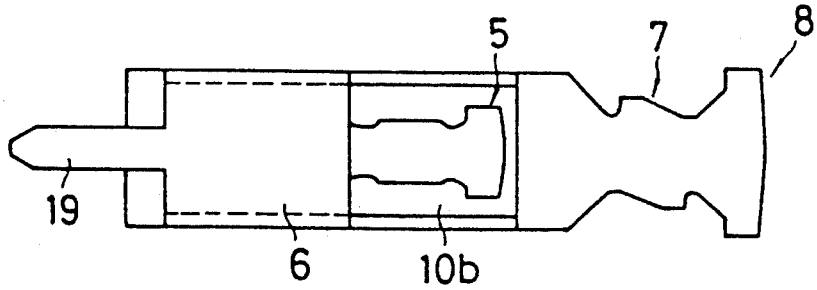
FIG. 5 is a bottom plan view thereof.
Figure 6:
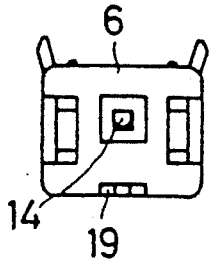
FIG. 6 is a front elevation thereof viewed from the arrow A of FIG. 4.
Figure 7:
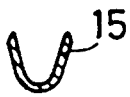
FIG. 7 is a cross section taken along the line B—B of FIG. 3.

As best shown in FIG. 2, the signal line barrel 5 has a signal terminal 14, a signal line crimping portion 15, and an insulator crimping portion 16. The signal terminal 14 is shaped in the form of a pin and extends forwardly from the front end of the shielding case 3 in parallel with the shield terminal 19. The signal line crimping portion 15 has a pair of U-shaped tabs while the insulator crimping portion 16 has a pair of U-shaped tabs 18. The signal line barrel 5 is supported by the insulation body 4 within the barrel retention portion 6 such that the signal line crimping portion 15 and the insulator crimping portion 16 are positioned in the jig inlets 10*a* and 10*b*.

In order to connect a shielded cable 2 to the connector 1, first of all, a length of outer sheath 23 is removed from the shielded cable 2 to expose the signal line (central conductor) 20, the intermediate insulator 21, the shield wires (outer conductor) 22 as shown in FIG. 1. The shielded cable 2 is placed on the connector 1 such that the signal line 20, the intermediate insulator 21, the shield wires 22, and the outer sheath 23 are placed on the signal line crimping portion 15, the insulator crimping tabs 18, the shield wires crimping tabs 12, and the outer sheath crimping tabs 13, respectively.

Figure 8:
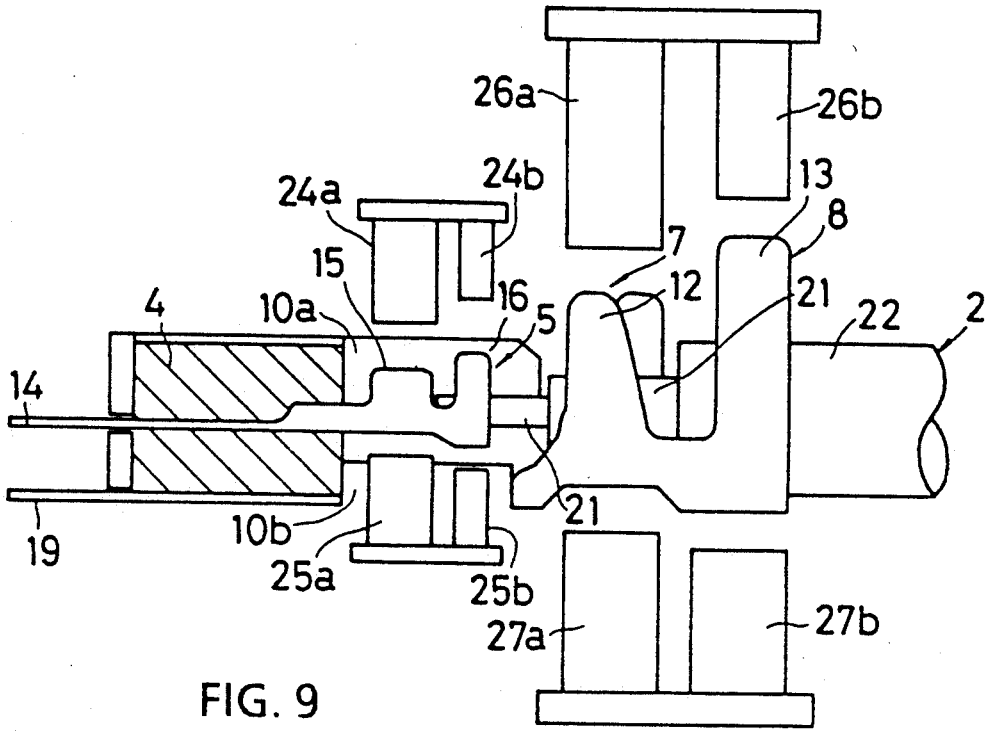
FIG. 8 illustrates how to connect a shielded cable to the board-in connector of FIG. 1.

As FIG. 8 shows, barrel crimping anvils 24*a* and 24*b* and clamper 25*a* and 25*b*, and shielding case crimping anvils 26*a* and 26*b* and clampers 27*a* and 27*b* are operated to simultaneously press the signal line crimping tabs 15 and the other crimping tabs 18, 12, and 23 onto the signal line 20, the intermediate insulator 21, the shield wires 22, and the outer sheath 23, respectively. More specifically, the barrel anvil 24*a* is inserted into the jig inlet 10*a* while the clamper 25*a* is inserted into the jig inlet 10*b* to press the crimping portion 15 onto the signal line 20. At the same time, the crimping anvil 24*b* is inserted into the jig inlet 10*a* while the clamper 25*b* is inserted into the jig inlet 10*b* to press the crimping tabs 18 onto the intermediate insulator 21. In addition, the shielding case anvils 26*a* and 26*b* and clampers 27*a* and 27*b* are operated to press the crimping tabs 12 and 13 onto the shield wires 22 and the outer sheath 23, respectively, to connect the shielded cable 2 to the connector 1.

Figure 9:
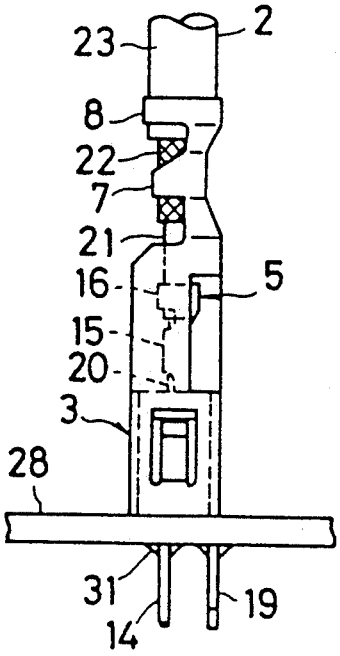
FIG. 9 illustrates how to use the board-in connector.
Figure 10:
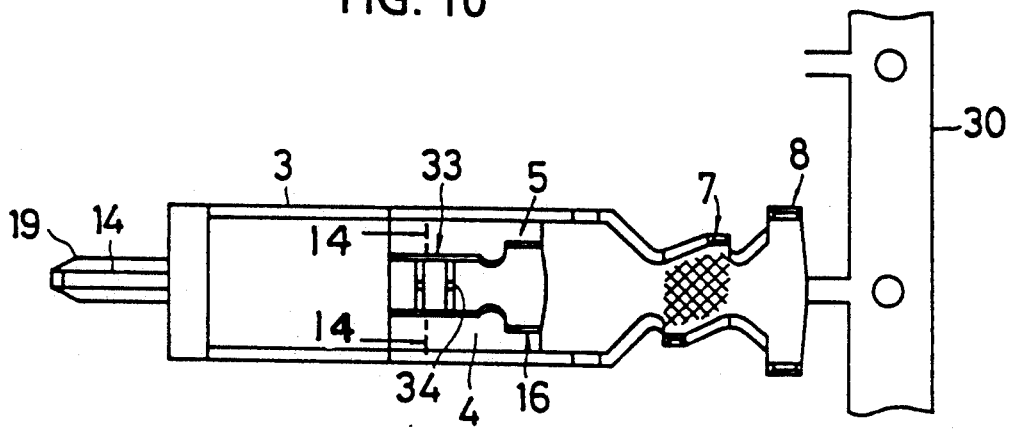
FIG. 10 is a top plan view of a shielded cable board-in connector according to another embodiment of the invention.
Figure 11:
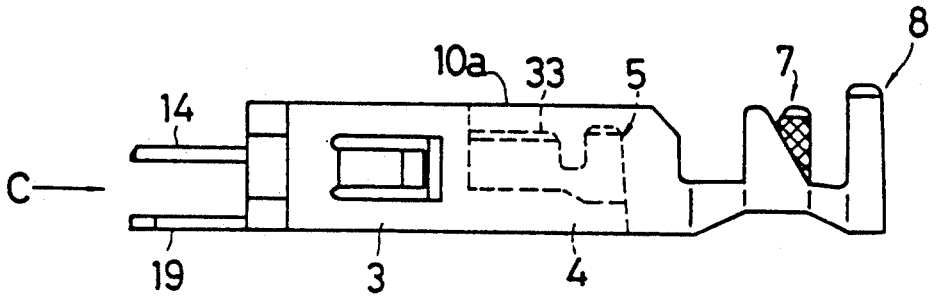
FIG. 11 is a side elevation thereof.
Figure 12:
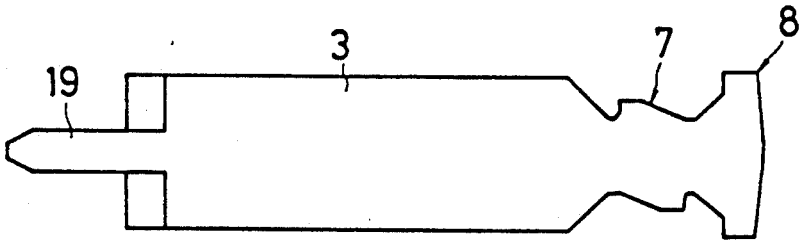
FIG. 12 is a bottom plan view thereof.
Figure 13:
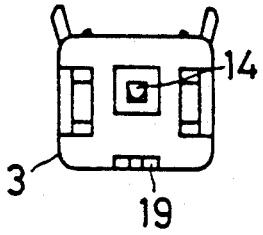
FIG. 13 is a front elevation viewed from the arrow C of FIG. 11.
Figure 14:
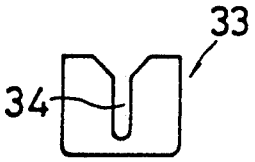
FIG. 14 is a cross section taken along the line D—D of FIG. 10.
Figure 15:
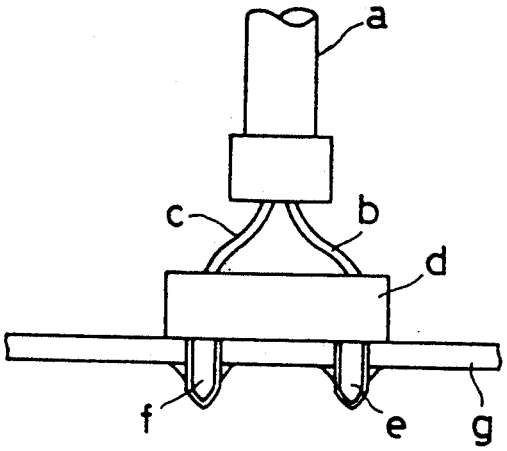
FIG. 15 PRIOR ART
FIGS. 15 and 16 show conventional board-in connectors.
Figure 16:
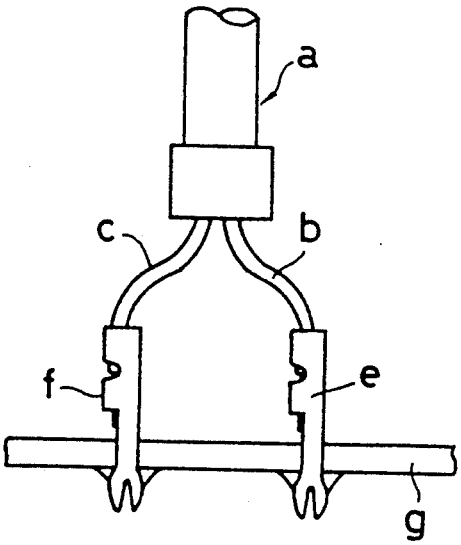
FIG. 16 PRIOR ART

As FIG. 9 shows, the shield terminal 19 and the signal terminal 14 are inserted into the through holes of a printed circuit board 28 and soldered at 31 for mounting them on the printed circuit board 28. A great number of shielded cables 2 are connected to connectors 1 as follows: A great number of shielding cases 3 are stamped from a metal sheet, with a strip 30 of the metal sheet left so that the connectors 1 are wound around a reel (not shown). When used, the connector strip 30 is unwound to effect connection of shielded cables 2 to the connectors 1 as described above.

FIGS. 10–14 show a board-in connector according to another embodiment of the invention. In this embodiment, the signal line crimping portion 15 is replaced by a signal line insulation displacing portion 33 with a slit 34 extending downwardly from the top edge thereof. In addition, the insulation body 4 extends rearwardly up to the end of the signal barrel 5, while the shielding case 3 has only one jig inlet 10*a* on the top face thereof.

In order to connect a shielded cable 2 to the board-in connector 1, the barrel anvil 24*a* is inserted into the jig inlet 10*a* to press the signal line 20 covered with the intermediate insulator 21 (or insulated conductor 20) onto the insulation displacing portion 33 for effecting connection by insulation displacement. The other features are the same as those of the above embodiment.

As has been described above, with the connector according to the invention, it is possible to simultaneously connect a shielded cable to the connector by placing the stripped cable on the connector such that the signal line, the shield wires, and the outer sheath are placed on the signal line connection portion, the shield wires crimping portion, and the outer sheath retention portion and inserting the barrel anvil into the jig inlet to connect the signal line to the signal line connection portion while using the crimping jig to press the crimping tabs to the shield wires and the outer sheath. This makes it possible to connect a great number of connectors continuously and automatically. In addition, the signal and shield terminals are integrated so that an excellent shielding effect is obtained.

I claim:

1. A shielded cable board-in connector directly mountable on a printed circuit board comprising:

a shielding case having a barrel retention portion having at a rear portion thereof a pair of diametrically opposed openings through which a pair of crimping dies are insertable, a U-shaped shield wire crimping portion extending rearwardly from said retention portion, a U-shaped outer sheath crimping portion extending rearwardly from said shield wire crimping portion, and a shield terminal extending forwardly from a lower front edge of said barrel retention portion to form a first pin-like terminal which is insertable through and directly solderable to a plated through hole of said printed circuit board;

a signal line barrel having at a rear portion thereof a U-shaped insulator crimping portion, a signal line connection portion extending forwardly from said insulator crimping portion and opening upwardly, and signal terminal extending forwardly from said signal line connection portion to form a second pin-like terminal which is insertable through and directly solderable to a plated through hole of said printed circuit board; and said shielded wire, outer sheath, and insulator crimping portions and said signal line connection portions being opened upwardly so that a prepared shield cable can be lowered onto said shield wire, outer sheath, and insulator crimping portion sand said signal line connection portion in a direction perpendicular to an axis of said shielding case while said shielded cable is kept in parallel to said axis, whereby said signal line connection portion and said shield wire crimping portion are simultaneously connected to said shielded cable.

2. The shielded cable board-in connector of claim 1, wherein said signal line connection portion has a pair of crimping tabs extending upwardly.

3. The shielded cable board-in connector of claim 1, wherein said signal line connection portion has an insulation displacing portion.

4. A shielded cable board-in connector directly mountable on a printed circuit board comprising:

a shielding case having a barrel retention section having at a rear portion thereof an upper opening through which a machine die is insertable, a U-shaped shield wire crimping portion extending rearwardly from said retention portion, and a U-shaped outer sheath crimping portion extending rearwardly from said shielded wire crimping portion, and a shield terminal extending forwardly from a lower front edge of said retention section to form a first pin-like terminal which is insertable through and directly solderable to a plated through hole of said printed circuit board;

a signal line barrel having a U-shaped insulator crimping portion, a signal line connection portion extending forwardly from said insulator crimping portion and opening upwardly, and a signal terminal extending forwardly from said signal line connection portion to form a second pin-like terminal which is insertable through and directly solderable to a plated through hole of said printed circuit board;

an insulation body with a lower rear portion provided within said barrel retention section such that said lower rear portion supports said signal line connection and insulator crimping portions; and said shield wire, outer sheath, and insulator crimping portions and said signal line connection portion being opened upwardly so that a prepared shielded cable can be lowered onto said shield wire, outer sheath, and insulator crimping portions and said signal line connection portion in a direction perpendicular to said axis while said shield cable is kept in parallel to said axis, thereby permitting simultaneously crimping and connection of said connector to said shielded cable.

5. The shielded cable board-in connector of claim 4, wherein said signal line connection portion has a pair of crimping tabs extending upwardly.

6. The shielded cable board-in connector of claim 4, wherein said signal line connection portion has an insulation displacing portion.

* * * * *